US011510506B1

(12) United States Patent
Farinola

(10) Patent No.: US 11,510,506 B1
(45) Date of Patent: Nov. 29, 2022

(54) EXPANDABLE RETAIL PUSHER DISPLAY

(71) Applicant: Nick Farinola, Kinnelon, NJ (US)

(72) Inventor: Nick Farinola, Kinnelon, NJ (US)

(73) Assignee: VIRA Insight, LLC, Lewisville, TX (US)

( * ) Notice: Subject to any disclaimer, the term of this patent is extended or adjusted under 35 U.S.C. 154(b) by 0 days.

(21) Appl. No.: 17/524,484

(22) Filed: Nov. 11, 2021

(51) Int. Cl.
*A47F 1/12* (2006.01)
*A47B 57/58* (2006.01)
*A47B 45/00* (2006.01)

(52) U.S. Cl.
CPC ..... *A47F 1/126* (2013.01); *A47B 45/00* (2013.01); *A47B 57/583* (2013.01)

(58) Field of Classification Search
CPC ..... A47F 1/126; A47F 5/10; A47F 5/0018; A47F 1/125; A47F 7/281; A47B 45/00; A47B 43/00; A47B 57/583; A47B 65/15; A47B 65/10; A47B 96/04; A47B 65/20; A47B 96/025; A47B 57/58
USPC ..... 211/59.3, 184, 175, 126.2, 132.1, 10, 211/195, 194, 200, 201, 202, 105, 149
See application file for complete search history.

(56) References Cited

U.S. PATENT DOCUMENTS 829,897 A * 8/1906 Schilling ..... A47F 5/01 211/49.1
892,413 A * 7/1908 Freeman ..... A47F 5/01 211/49.1
1,143,668 A * 6/1915 Walz ..... A47B 45/00 312/351
1,198,450 A * 9/1916 Jones ..... A61B 18/14 211/202
1,379,700 A * 5/1921 Scheu ..... D06F 57/12 160/136
1,704,011 A * 3/1929 Hobart ..... A47B 65/10 211/105
3,124,252 A * 3/1964 Canham ..... A47B 45/00 211/43
3,142,355 A * 7/1964 Danielson ..... E06C 1/39 182/161
3,181,705 A * 5/1965 Nawman ..... B65D 7/26 206/509
3,410,328 A * 11/1968 Sasai ..... B65D 7/26 5/98.1
3,490,603 A * 1/1970 Willer ..... H05K 7/1417 248/172
3,612,284 A * 10/1971 Stoltz ..... D06F 57/12 211/105
3,759,475 A * 9/1973 Brown ..... H05K 7/1421 312/273
4,177,902 A 12/1979 Winn
(Continued)

*Primary Examiner* — Jennifer E. Novosad
(74) *Attorney, Agent, or Firm* — Dan Brown Law Office; Daniel R. Brown

(57) ABSTRACT

An expandable product pusher display for displaying products while urging the products to the front of the display as they are removed by consumers. Left and right end caps support plural tiers of product pusher assemblies, each including left and right product platforms with pushers having springs arranged to urge the products forwardly. Each tier includes a scissor mechanism expandably disposed between the left and right product platforms, and configured to adjust the distance therebetween while maintaining parallel alignment, so as to accommodate products of different width through adjustment of the scissor mechanisms.

18 Claims, 7 Drawing Sheets

(56) References Cited

U.S. PATENT DOCUMENTS 4,303,162 A 12/1981 Suttles
4,703,703 A * 11/1987 Taub ..... A47B 45/00 108/184
4,762,236 A 8/1988 Jackie, III et al.
4,771,977 A * 9/1988 Larson ..... A47B 23/043 248/446
4,898,282 A * 2/1990 Hawkinson ..... A47F 1/126 211/49.1
5,069,349 A * 12/1991 Wear ..... A47F 1/126 211/59.3
5,119,944 A * 6/1992 Milton ..... A47F 1/12 211/104
5,190,186 A 3/1993 Yablans et al.
D339,371 S * 9/1993 Crist ..... D18/49
5,269,112 A * 12/1993 Weinrub ..... G09F 15/0068 52/646
5,366,099 A * 11/1994 Schmid ..... A47F 1/126 211/59.3
5,472,082 A * 12/1995 Thiele ..... A45C 7/0031 190/22
5,492,237 A * 2/1996 Chang ..... A47L 19/04 211/202
5,622,676 A * 4/1997 Lind ..... B01L 9/543 206/443
5,797,499 A * 8/1998 Pinco ..... A47F 7/30 211/175
6,257,442 B1 * 7/2001 Fredmark ..... B65D 21/086 220/9.4
6,382,435 B1 * 5/2002 Legaz ..... B62B 3/025 211/175
6,427,607 B1 * 8/2002 Palmer ..... A47G 21/08 108/43
6,454,106 B1 * 9/2002 Howard ..... A47B 45/00 248/448
6,745,906 B1 6/2004 Nagel
7,150,365 B2 12/2006 Hardy et al.
7,445,126 B2 * 11/2008 Wilson ..... B65G 1/07 211/1.51
7,451,881 B2 11/2008 Hardy et al.
7,458,473 B1 * 12/2008 Mason ..... A47F 1/126 211/59.3
7,478,731 B1 * 1/2009 Mason ..... A47F 1/126 211/59.3
7,661,545 B2 2/2010 Hardy et al.
7,810,657 B2 * 10/2010 Davison ..... A47B 96/025 211/100
7,850,015 B1 * 12/2010 Mason ..... A47F 1/087 211/175
8,047,385 B2 11/2011 Hardy
8,235,227 B2 8/2012 Hardy
8,720,702 B2 5/2014 Nagel
8,950,602 B2 * 2/2015 Fanourgiakis ..... A47F 5/0018 211/175
8,967,393 B2 3/2015 Bryson et al.
9,138,076 B2 9/2015 Hardy
9,642,475 B2 * 5/2017 Vogler ..... A47F 5/0846
9,901,191 B1 * 2/2018 Schmidt ..... A47F 5/005
9,968,206 B2 * 5/2018 Hardy ..... A47F 7/281
10,271,710 B2 * 4/2019 Wegner ..... A47L 15/506
10,308,423 B1 * 6/2019 Cui ..... B65D 90/027
10,413,090 B2 * 9/2019 Hardy ..... A47B 65/15
2003/0196975 A1 * 10/2003 Murray ..... A47F 5/137 211/126.2
2003/0217980 A1 * 11/2003 Johnson ..... A47F 1/126 211/59.3
2004/0020887 A1 * 2/2004 Jersey ..... A47B 45/00 211/189
2005/0199564 A1 * 9/2005 Johnson ..... A47F 1/126 211/59.3
2005/0199565 A1 * 9/2005 Richter ..... A47F 3/14 211/59.3
2006/0180603 A1 * 8/2006 Eckert ..... G07F 11/42 211/59.3
2007/0108142 A1 * 5/2007 Medcalf ..... A47F 1/126 211/59.3
2007/0267365 A1 * 11/2007 Saito ..... A47F 1/126 211/59.3
2014/0197121 A1 * 7/2014 Knight ..... A47B 88/994 29/428
2015/0034576 A1 * 2/2015 Wong ..... A47F 5/005 211/59.3

* cited by examiner

SECTION A-A 38,40

EXPANDABLE RETAIL PUSHER DISPLAY

RELATED APPLICATIONS

None.

BACKGROUND OF THE INVENTION

Field of the Invention

The present disclosure generally relates to retail merchandise display fixtures. More particularly, the present disclosure relates to expandable pusher type displays including single and multiple tier pusher platforms.

Description of Related Art

Display fixtures for consumer products in retail are important for efficient utilization of limited shelf space, convenience for consumers, and for generally incentivizing purchases by consumers. Retailers continually demand improved fixtures of various types. One type of retail display fixture is the 'pusher' fixture. A pusher fixture receives a row of products, presenting the frontmost for retrieval by a consumer, and incorporates a biased member that urges the subsequently available products to the front of the display upon removal of the prior. A range of pusher fixtures are available to retailers. One challenge in pusher fixture design is the variability of product packaging size and shape. Another challenge is the ability of the fixture to maintain the reserve of products in an orderly fashion. Another is the need to efficiently utilize the limited shelf space volume available for any given product. Of course, the cost of the pusher fixture is also important for both the retailer employing its use as well as the vendor providing such fixtures to retailers.

With respect to the variability of product packaging size, it is known to provide a pusher fixture with adjustable side panels that can be expanded and contracted according to the size fo the product. With this arrangement, it is necessary to locate the pusher near the center of the fixture, otherwise the force urging the product into position my skew the row of products in the fixture, resulting in mis-arrangement or jamming of the product. A similar issue exists for adjustability of height between tiers of product in a multi-tiered pusher fixture. Thus is can be appreciated that there is a need in the art for an expandable retail pusher display fixture that is efficient in its utilization of shelf space, adjustable to accommodate various product packing sizes from time to time, cost effective, and reliable in its operation.

SUMMARY OF THE INVENTION

The need in the art is addressed by the apparatuses and methods of the present invention. The present disclosure teaches an expandable product pusher display assembly for displaying a plurality of products and urging the products to the front of the display assembly as each individual product is removed by customers. The assembly includes left and right end caps that each have a vertical attachment face, and a first tier product pusher assembly that has a first set of left and right product platforms, which are each attached to the vertical attachment faces of the left and right end caps, correspondingly, and where each first tier product pusher assembly has a pusher that is slidably engaged therewith, and each having a means for urging the pusher toward the front of the display assembly. The first tier product pusher assembly further includes a first scissor mechanism expandably disposed between the first set of left and right product platforms, and configured to adjust the distance therebetween while maintaining parallel alignment therebetween, so as to accommodate products of different width through adjustment of the first scissor mechanism.

In a specific embodiment of the foregoing assembly, the first scissor mechanism further includes left and right scissor stages attached to the first set of left and right product platforms, correspondingly, which include a flat scissor link and an offset scissor link joined along their lengths by a hinge, and coupled to each of the left and right scissor stages by a pivot connection and a slide connection. In a refinement to this embodiment, the pivot connections are formed with a pivot pin on each of the flat and offset scissor links and a pivot hole formed in each of the left and right scissor stages, and wherein the slide connection is formed with a slide pin on each of the flat and offset scissor links and a slide slot formed in each of the left and right scissor stages.

In a specific embodiment of the foregoing assembly, the means for urging the pushers are spiral springs each having an attachment tab engaged with a corresponding one of the first set of left and right product platforms, and urgingly engaged with a corresponding one of the pushers.

In a specific embodiment of the forego assembly, the first set of left and right product platforms are attached to the left and right end caps with plural tabs inserted into plural slots.

In a specific embodiment of the foregoing assembly, each of the pushers further includes a guide foot extending therefrom, and the first set of left and right product platforms each have a guide channel formed therein for slidably engaging the guide feet.

In a specific embodiment of the foregoing assembly, a second tier product pusher assembly has a second set of left and right product platforms, each attached to the vertical attachment faces of the left and right end caps, correspondingly, and each having a pusher slidably engaged therewith, and each having a means for urging the pusher toward the front of the display assembly, and, the second tier product pusher assembly further includes a second scissor mechanism expandably disposed between the second set of left and right product platforms and configured to adjust the distance therebetween while maintaining parallel alignment therebetween, and further wherein the second tier product assembly is located above the first tier product pusher assembly. In a refinement to this embodiment, the first and second product pusher assemblies are adjustably attached to the left and right vertical attachment faces to facilitate adjustment of the vertical and horizontal spacing between the first and second product pusher assemblies. In another refinement to this embodiment, the first and second sets of left and right product platforms are adjustably attached to the left and right end caps with a plurality of tabs inserted into a plurality of slots.

The present disclosure teaches a method of displaying and dispensing a plurality of products using an expandable product pusher display that includes left and right end caps, each including a vertical attachment face, and a first tier product pusher assembly that includes a first set of left and right product platforms, each attached to a vertical attachment face of the left and right end caps, correspondingly, and each including a pusher that is slidably engaged therewith, and each including a means for urging the pusher toward the front of the display assembly, wherein the first tier product pusher assembly includes a first scissor mechanism disposed between the first set of left and right product platforms. The method includes the steps of adjusting the distance between the first set of left and right product platforms of the first tier product pusher assembly by adjusting the width of the first scissor mechanism to accommodate the width of the plurality of products, and, inserting the plurality of products into the product pusher display, each urging the left and right pushers rearwardly against their respective means for urging the pusher forward, and while maintaining parallel alignment between the first set of left and right product platforms, and further urging the pushers of the first set of left and right product platforms forward by the corresponding means for urging the pusher toward the front of the display assembly upon removal of each unit of the plurality of products from the expandable product pusher display.

In a specific embodiment of the foregoing method, the first scissor mechanism further includes left and right scissor stages attached to the first set of left and right product platforms, correspondingly, and a flat scissor link and an offset scissor link joined along their lengths by a hinge, and coupled to each of the left and right scissor stages by a pivot connection and a slide connection, to thereby maintain the parallel alignment between the first set of left and right product platforms. In a refinement to this embodiment, the pivot connections are formed with a pivot pin on each of the flat and offset scissor links and a pivot hole formed in each of the left and right scissor stages, and the slide connection is formed with a slide pin on each of the flat and offset scissor links and a slide slot formed in each of the left and right scissor stages.

In a specific embodiment of the foregoing method, the means for urging the pushers are spiral springs, each having an attachment tab engaged with a corresponding one of the first set of left and right product platforms, and urgingly engaged with a corresponding one of the pushers.

In a specific embodiment of the foregoing method, each of the first set of left and right end caps are formed with plural mounting slots, and each of the left and right product pusher assemblies are formed with plural mounting tabs, and further including the steps of attaching the left and right product pusher assemblies to the left and right end caps, respectively, by engaging selected mounting tabs with selected mounting slots.

In a specific embodiment of the foregoing method, each of the pushers further include a guide foot extending therefrom, and the first set of left and right product platforms each have a guide channel formed therein, and the method further includes slidably engaging the guide feet with the guide channels.

In a specific embodiment of the foregoing method, the product pusher display further includes a second tier product pusher assembly with a second set of left and right product platforms, each attached to the vertical attachment faces of the left and right end caps, correspondingly, each having a pusher slidably engaged therewith, and each having a means for urging the pusher toward the front of the display assembly, and wherein the second tier product pusher assembly further includes a second scissor mechanism expandably disposed between the second set of left and right product platforms, and the method further includes locating the second tier product assembly above the first tier product pusher assembly. In a refinement to this embodiment, the method further includes adjustably locating and attaching the first and second product pusher assemblies to the left and right vertical attachment faces, thereby facilitating adjustment of the vertical and horizontal spacing between the first and second product pusher assemblies. In another refinement the method further includes adjustably attaching the first and second sets of left and right product platforms to the left and right end caps using a plurality of tabs inserted into a plurality of slots.

DESCRIPTION OF THE INVENTION

Figure 1:
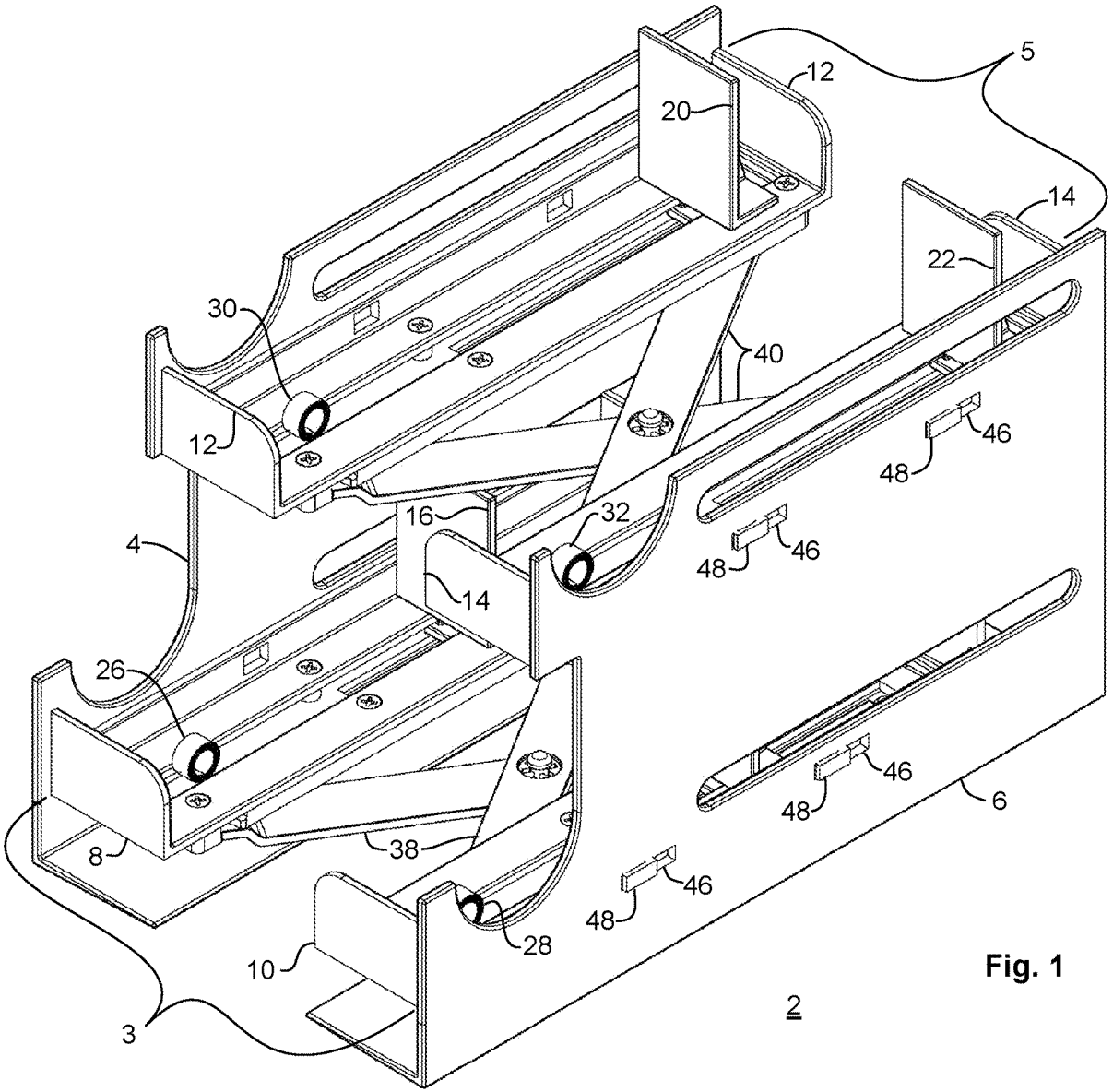
FIG. 1 is a perspective view drawing of an expandable pusher display according to an illustrative embodiment of the present invention.

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope hereof and additional fields in which the present invention would be of significant utility.

In considering the detailed embodiments of the present invention, it will be observed that the present invention resides primarily in combinations of steps to accomplish various methods or components to form various apparatus and systems. Accordingly, the apparatus and system components, and method steps, have been represented where appropriate by conventional symbols in the drawings, showing only those specific details that are pertinent to understanding the present invention so as not to obscure the disclosure with details that will be readily apparent to those of ordinary skill in the art having the benefit of the disclosures contained herein.

In this disclosure, relational terms such as first and second, top and bottom, upper and lower, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a" does not, without more constraints, preclude the existence of additional identical elements in the process, method, article, or apparatus that comprises the element.

The present disclosure presents illustrative embodiments of retail pusher display assemblies that are suitable for elongated packages such as boxed toothpaste. Such products are presented in a horizontal fashion where the width of the product package is its greatest dimension. Products are arranged in rows, front to back, urged forward by a pusher assembly in the fixture. These types of product come in various size boxes, and it is the retailers' desire to utilize a single pusher fixture to accommodate all of them. Since the height of such packages is a lesser of its three dimensions, it is typically desirable for the retail display to present two or more tiers of rows of products, each individually urged froward by a discrete pusher. In this manner, each of the several tiers presents a product in the frontmost position for easy access by a consumer. The fixture assembly enables adjustment of both the product width and the product height, maintaining them is compact, organized fashion and readily retrievable by a consumer.

Reference is direct to FIG. 1, which is a perspective view drawing of an expandable pusher display assembly 2 according to an illustrative embodiment of the present invention. This embodiment presents a two tier arrangement of product pusher assemblies 3, 5 disposed between a pair of left and right end caps 4, 6. The pusher display assembly 2 occupies a horizontal space on a retail shelf defined by the pair of left and right end caps 4, 6, which are left-to-right mirror images of one another. Each end cap 4, 6 has a plurality of slots 46 formed therethrough, which are used as assembly connectors in the illustrative embodiment. The lower tier product pusher assembly 3 is comprise of left and right product platforms 8, 10, respectively, which are also mirror images of one another, as well as a scissor mechanism 38 and certain other components. The upper tier product pusher assembly 5 is also comprised of left and right product platforms 12, 14, respectively, and a scissor mechanism 40, as well as other components. The pairs of product platforms 8, 10 and 12, 14 are expandably connected by the respective scissor mechanisms 38, 40. All of the product platforms 8, 10, 12, 14 have plural mounting tabs 48, which extend through and engage corresponding slots 46 in the left and right end caps 4, 6, as illustrated. As such, the end caps 4, 6 move together with the product platforms 8, 10, 12, 14 as the scissor mechanisms 38, 40 are expanded and collapsed. In this manner, the entire display assembly 2 is expandable in width according to the expansion and contraction of the scissor mechanisms 38, 40. In this embodiment the upper and lower tier pusher assemblies 3, 5 are vertically located by the tab 48 and slot 46 arrangement. Note that in other illustrative embodiments, there are columns of slots 46 in the left and right end caps 4, 6, which enable adjustment of the vertical spacing between the product pusher assemblies 3, 5. In this illustrative embodiment, the various components are formed of suitable molded plastics, as are known to those skilled in the art.

Each of the four product platforms 8, 10, 12, 14 in the illustrative embodiment includes a spirally wound spring 26, 28, 30, 32 which engage and urge forwardly corresponding pushers 16, 20, 22 (note that product platform 10 also has a pusher, which is not visible in FIG. 1). In this drawing FIG. 1, the spiral springs 16, 20, 22 are shown in the fully coiled (relaxed) condition, and have not been unwound and placed behind their corresponding pushers 16, 20, 22. This is for drawing clarity purposes, and will be discussed more fully hereinafter.

Figure 2B:
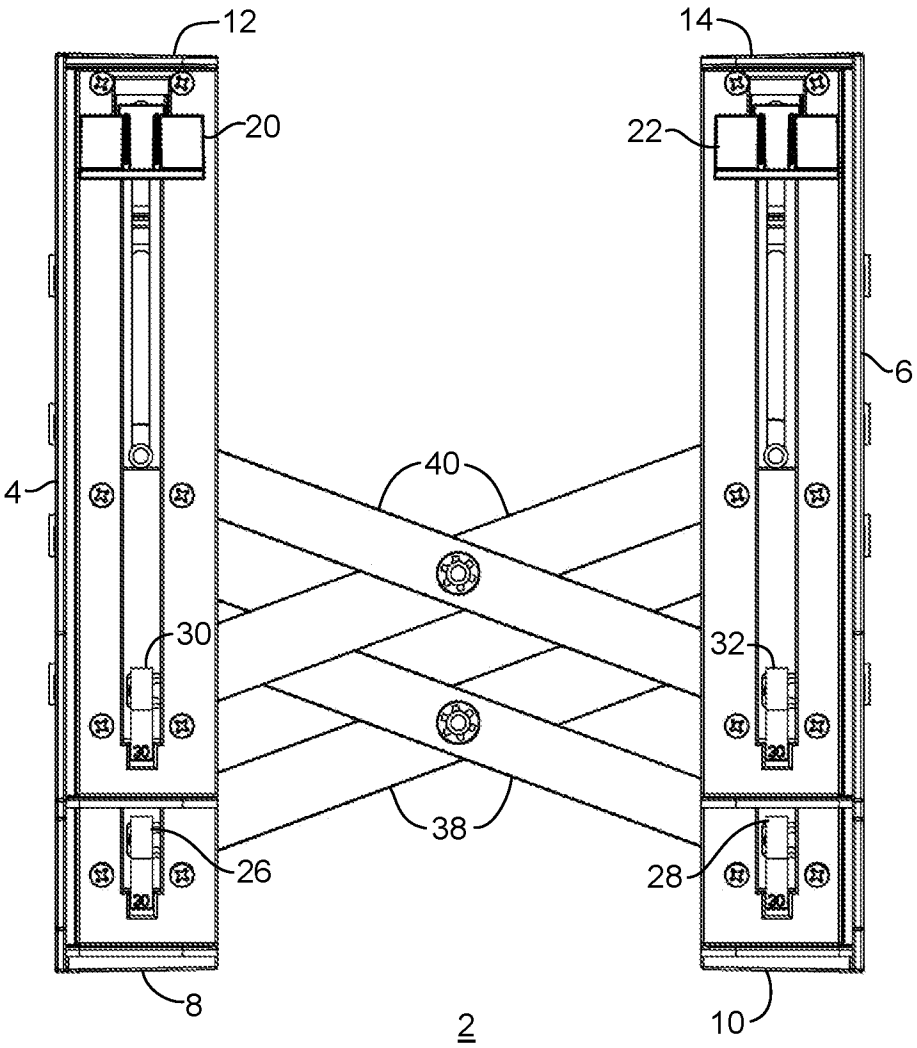
FIGS. 2A and 2B are top view drawings of an expandable pusher display in the collapsed and expanded positions, respectively, according to an illustrative embodiment of the present invention.
Figure 2A:
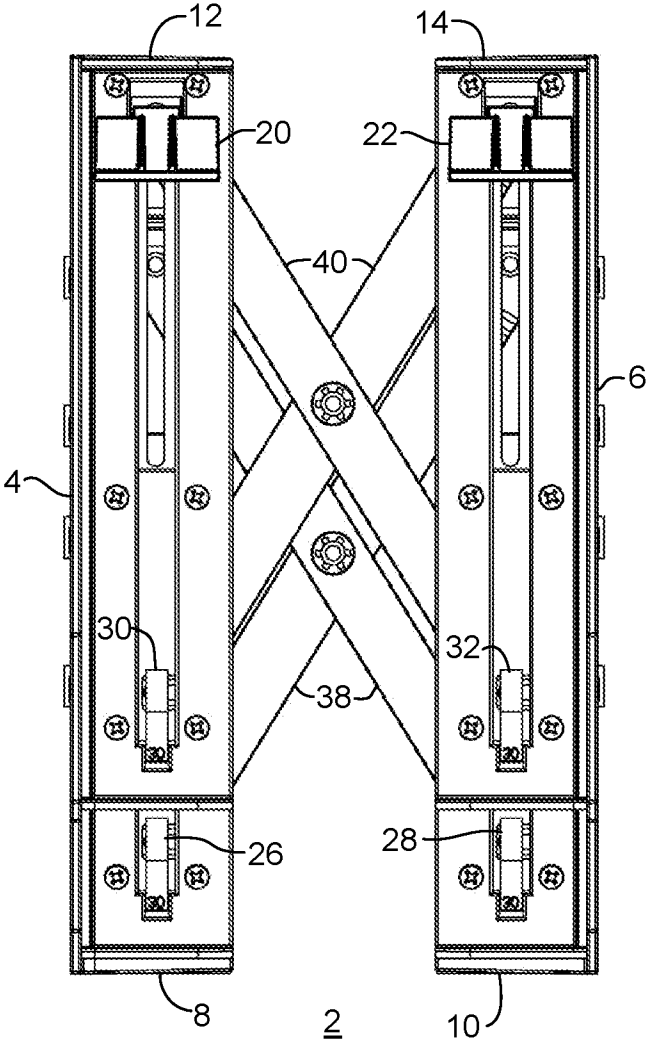

Reference is direct to FIG. 2A and 2B, which are top view drawings of an expandable pusher display assembly 2 in the collapsed (FIG. 2A) and extended (FIG. 2B) positions, respectively, according to an illustrative embodiment of the present invention. The top edge of left and right end caps 4, 6 can be seen, to which are connected the lower tier product platforms 8, 10 and the upper tier product platforms 12, 14. The respective lower and upper scissor mechanisms 38, 40 are also shown in the collapsed (FIG. 2A) and extended (FIG. 2B) positions. In these views, it can be appreciated that each item of product (not shown) that rests upon a pairs of product platforms 8, 10 or 12, 14, are urged forwardly by two pushers, for example pushers 20, 22 in the upper tier pair of product platforms 12, 14. This presents balanced pushing forces upon the row of products (not shown) that prevent the skewing or mis-arrangement of the products as they are removed by consumers. Also note in these FIGS. 2A and 2B that the spiral springs 26, 28, 30, 32 are illustrated in the relaxed position, and have not be extended to reach behind their respective pusher (only upper pushers 20, 22 are visible), which is how the springs 26, 28, 30, 32 supply a means for urging the pushers forward. Further details on the arrangement and operation of the pushers and scissor mechanisms 38, 40 will be more fully discussed hereinafter.

Figure 3B:
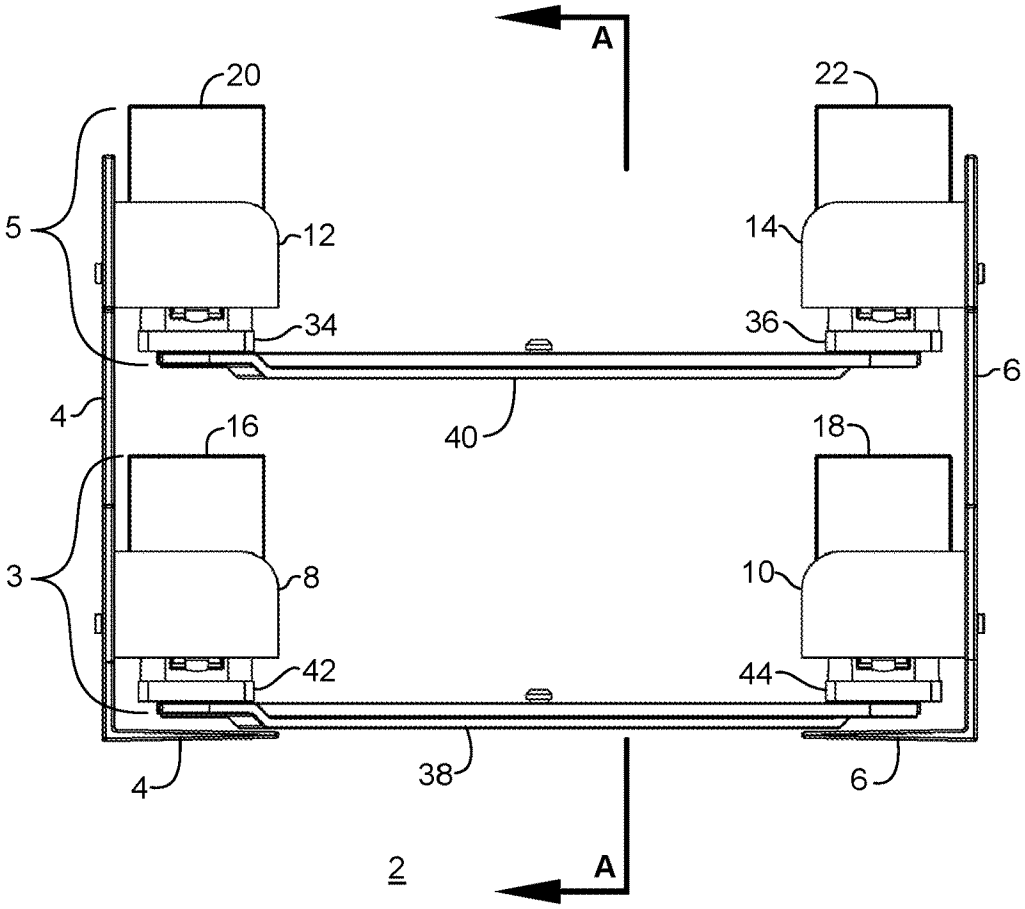
FIGS. 3A and 3B are front view drawings of an expandable pusher display in the collapsed and expanded positions, respectively, according to an illustrative embodiment of the present invention.
Figure 3A:
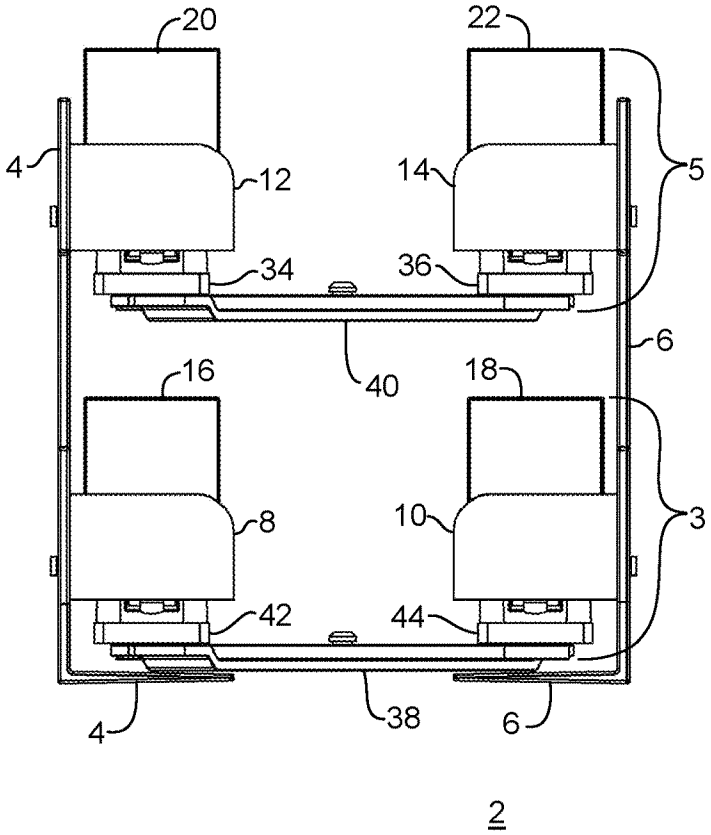

Reference is direct to FIG. 3A and 3B, which are front view drawings of an expandable pusher display assembly 2 in the collapsed (FIG. 3A) and extended (FIG. 3B) positions, respectively, according to an illustrative embodiment of the present invention. The left and right end caps 4, 6 can be seen, which are configured to rest upon a horizontal surface, such as a retail display shelf or counter surface. The end caps 4, 6 are connected the lower tier product pusher assemblies 3 and the upper tier product pusher assemblies 5, as illustrated. Each product pusher assembly 3, 5 is comprised of a pair of left and right product platforms, 8, 10 for the lower assembly 3 and 12, 14 for the upper tier assembly 5, and respective lower and upper scissor mechanisms 38, 40, which are also shown in the collapsed (FIG. 3A) and extended (FIG. 3B) positions. Note that is these views, the scissor mechanisms 38, 40 each comprise left and right scissor stages 42, 44 in the lower tier assembly 3 and 34, 36 in the upper tier assembly 5 . The scissor stages 42, 44, 34, 36 facilitate the extension and contraction of the assemblies, as well at the maintenance of a parallel alignment between the corresponding product platforms 8, 10 and 12, 14, as will be more fully described hereinafter. In these views, all of the four pushers 16, 18, 20, 22 can be seen in alignment with their respective product platforms 8, 10, 12, 14, as illustrated.

Figure 4:
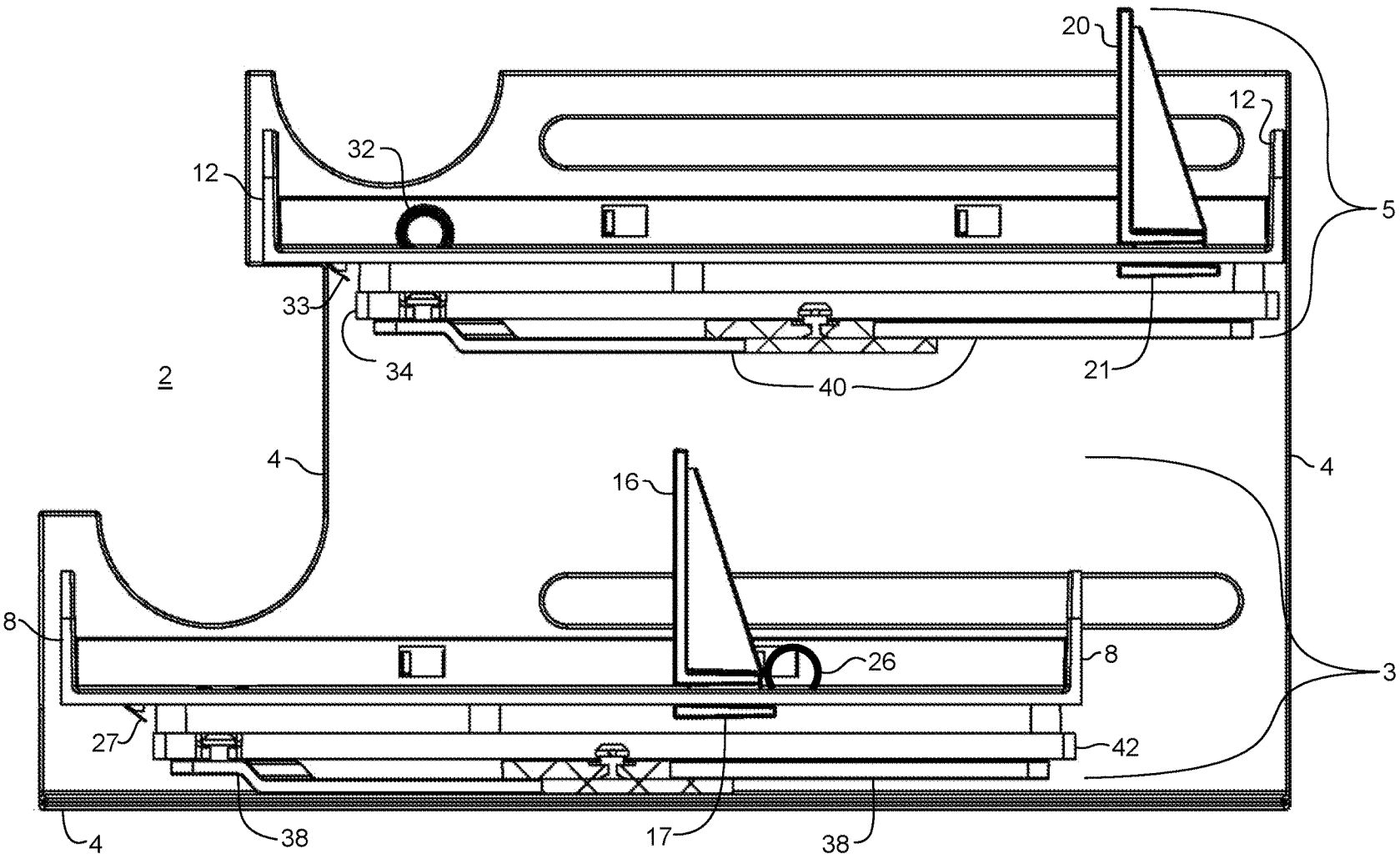
FIG. 4 is a section view drawing of an expandable pusher display according to an illustrative embodiment of the present invention.

Reference is direct to FIG. 4, which is a section view drawing (Section A-A taken in FIG. 3B) of an expandable pusher display 2 according to an illustrative embodiment of the present invention. In this view, the left end cap 4 is visible with the lower tier left product pusher assembly 3 and upper tier left product pusher assembly 5 illustrated in vertical arrangement and attached thereto. Considering the lower tier product pusher assembly 3, the pusher 16 includes a guide foot 17 that is engaged to slide forwardly along product platform 8 under urging of the spiral spring 26, which is shown in an extended position and engaging the back the the pusher 16. The front end of the spring 26 has an attachment tab 27 that is inserted into a slot (not illustrated) in the product platform 8. The scissor mechanism 38 is attached to the bottom of the product platform 8 by scissor stage 42, which is pivotally and slidably connected to the scissor mechanism 38, and which will be more fully discussed hereinafter. Likewise, for the upper tier product pusher assembly 5, the pusher 20 includes a guide foot 21 that is engaged to slide forwardly along product platform 12 under urging of the spiral spring 32, which is shown in its relaxed position and not yet extended to engage the back the the pusher 20. The front end of the spring 32 has an attachment tab 33 that is inserted into a slot (not illustrated) in the product platform 12. The scissor stage 34 is attached to the bottom of the product platform 12, and is pivotally and slidably connected to the scissor mechanism 40.

Figure 5:
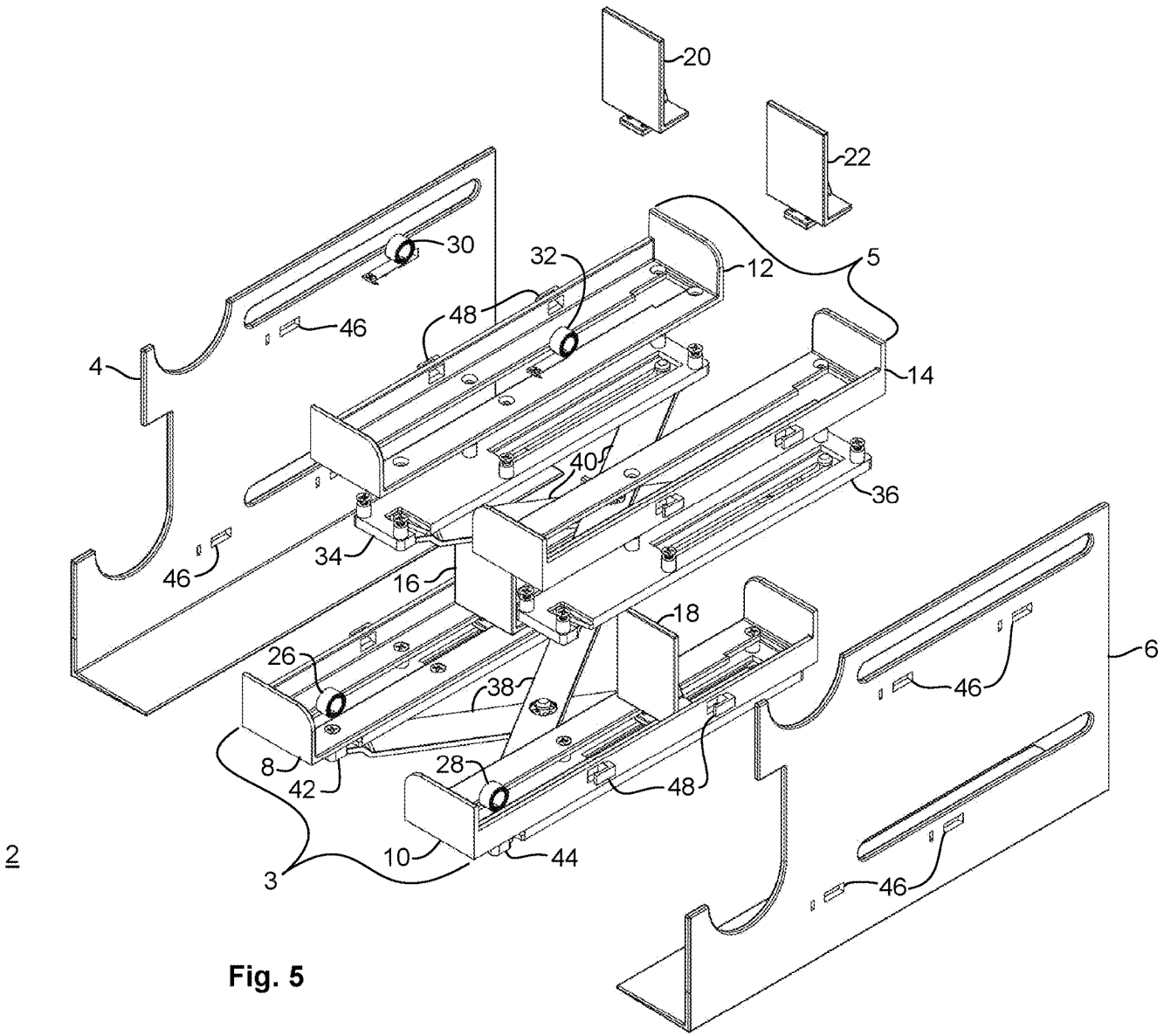
FIG. 5 is an exploded view drawing of an expandable pusher display according to an illustrative embodiment of the present invention.

Reference is direct to FIG. 5, which is an exploded view drawing of an expandable pusher display assembly 2 according to an illustrative embodiment of the present invention. This embodiment presents a two tier arrangement of product pusher assemblies 3, 5 disposed between a pair of left and right end caps 4, 6. Each end cap 4, 6 has a plurality of slots 46 formed therethrough, which are used as assembly connectors in the illustrative embodiment. The lower tier product pusher assembly 3 is comprise of left and right product platforms 8, 10, respectively, which are also mirror images of one another, as well as a left and right pair of scissor stages 42, 44 and a scissor mechanism 38. The upper tier product pusher assembly 5 is also comprised of left and right product platforms 12, 14, respectively, and a left and right pair of scissor stages 34, 36 and a scissor mechanism 40. The pairs of product platforms 8, 10 and 12, 14 are expandably connected by the respective scissor stages 42, 44, 34, 36 and scissor mechanisms 38, 40. All of the product platforms 8, 10, 12, 14 have plural mounting tabs 48, which extend through corresponding slots 46 in the left and right end caps 4, 6, as illustrated. The product platforms 8, 10, 12, 14 each have corresponding pushers 16, 18, 20, 22 and corresponding spiral springs 26, 28, 30, 32 shown in exploded positions.

Figure 6:
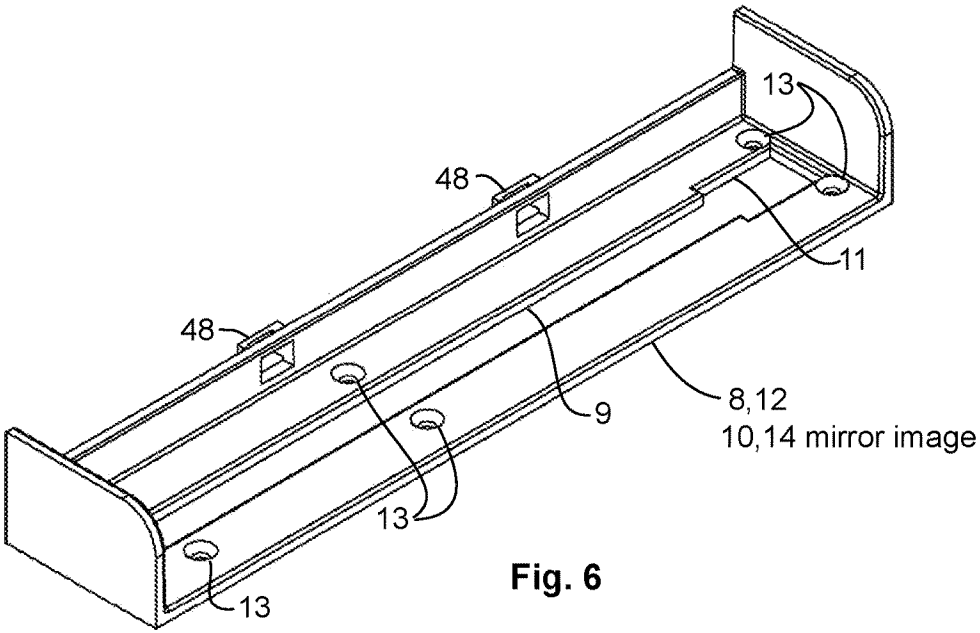
FIG. 6 is a perspective view drawing of a product platform for an expandable pusher display according to an illustrative embodiment of the present invention.

Reference is direct to FIG. 6, which is a perspective view drawing of a product platform for an expandable pusher display according to an illustrative embodiment of the present invention. This figure illustrates product platforms 8, 12, but it is noted that product platforms 10, 14 are left-to-right mirror images. The product platform includes plural mounting tabs 48 for engaging the aforementioned end caps (not shown). A pusher channel 9 is formed into the base of the product platform for accepting the pusher guide foot (not shown). An enlarged insertion portion 11 is provided for insertion of the guide foot during assembly. Plural mounting holes 13 are provided for attachment of the scissor stage (not shown). The arrangement of the product platforms 8, 10, 12, 14 are otherwise as illustrated in this FIG. 6.

Figure 7:
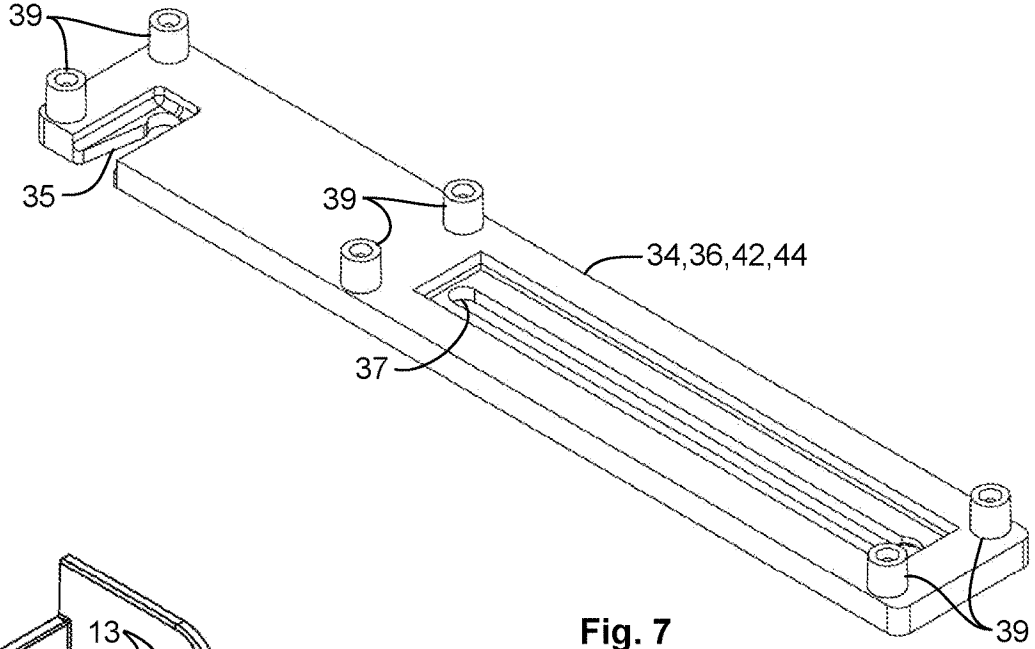
FIG. 7 is a perspective view drawing of a scissor stage for an expandable pusher display according to an illustrative embodiment of the present invention.

Reference is direct to FIG. 7, which is a perspective view drawing of the scissor stages 34,36,42,44 for an expandable pusher display according to an illustrative embodiment of the present invention. The scissor stages 34,36,42,44 each include plural mounting bosses 39 for accepting mounting screws (not shown) attaching them to their respective product platforms (not shown). A scissor slide slot 37 is formed into the scissor stage for slidably accepting a slide pin in the scissor mechanism (not shown). A keyhole pivot 35 is also formed into the scissor stage for pivotally engaging a scissor mechanism pivot pin (not shown). Note that the keyhole arrangement enables a snap- together assembly step in attaching the scissor mechanism to the scissor stage. The arrangement of the scissor stages 34,36,42,44 are otherwise as illustrated in this FIG. 7.

Figure 8:
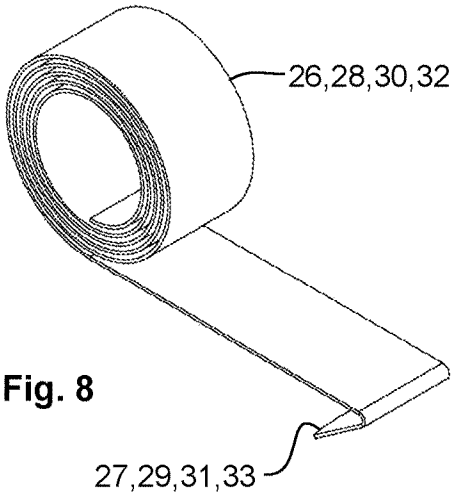
FIG. 8 is a drawing of a spiral spring for an expandable pusher display according to an illustrative embodiment of the present invention.

Reference is direct to FIG. 8, which is a drawing of the spiral springs 26,28,30,32 for an expandable pusher display according to an illustrative embodiment of the present invention. The spiral spring is formed of spring steel and is illustrated in its relaxed position, requiring a predetermined amount of force to unroll the spring, which is thirty pounds in the illustrative embodiment. Each string has an attachment tab 27,29,31,31, respectively, for retention by insertion into a mounting slot formed in their respective product platforms (not shown). In application, the coiled portion of the spring rests against the back of each product pusher (not shown) to apply a forwardly urging force thereto.

Figure 9:
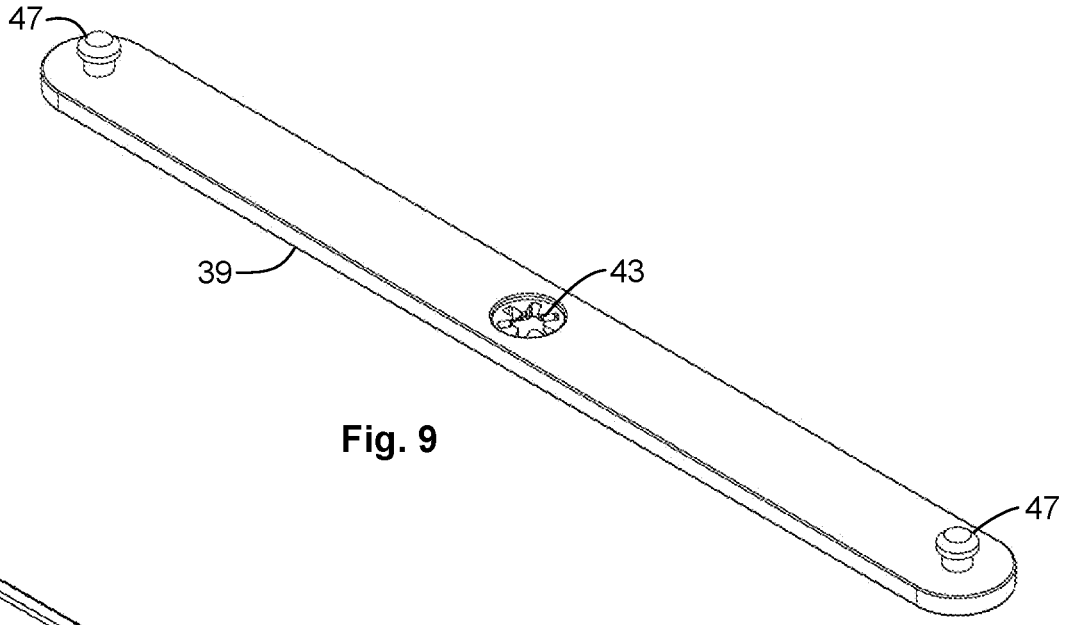
FIG. 9 is a perspective view drawing of a flat scissor link for an expandable pusher display according to an illustrative embodiment of the present invention.
Figure 10:
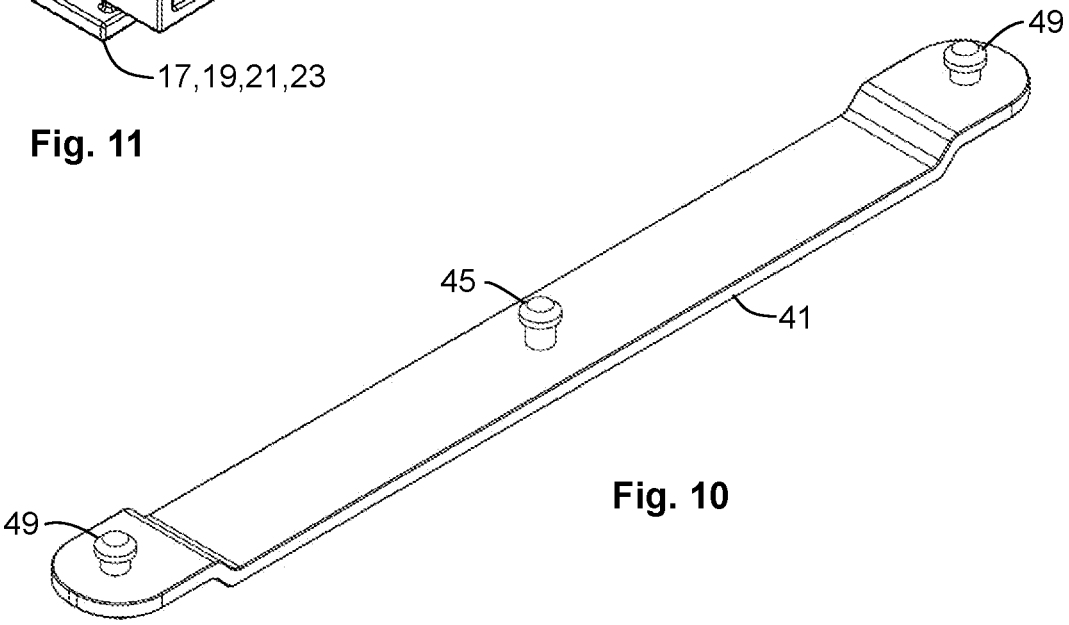
FIG. 10 is a perspective view drawing of an offset scissor link for an expandable pusher display according to an illustrative embodiment of the present invention.

Reference is direct to FIG. 9 and FIG. 10, which are a perspective view drawings of a flat scissor link 39 and an offset scissor link 41 for an expandable pusher display according to an illustrative embodiment of the present invention. The two scissor links 39,41 are joint together by hinge pin 45 and hinge socket 43 to form a completed scissor mechanism 38,40 as described in the prior drawing figures. Each link 39,41 has a pair of pins 47,49, respectively, extending therefrom, which serve as a pivot pin or a slide pin depending on the assembled position. During assembly, the pivot pin is inserted into the keyhole pivot in the scissor stage and the slide pin is inserted into the slide slot of the scissor stage. The pivot and slide arrangement enables expansive operation of the scissor stage while maintaining parallel alignment of the connected product platforms (not shown).

Figure 11:
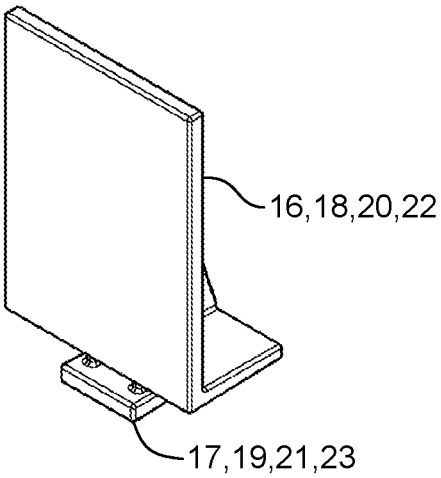
FIG. 11 is a perspective view drawing of a pusher according to an illustrative embodiment of the present invention.

Reference is direct to FIG. 11, which is a perspective view drawing of the product pushers 16,18,20,22 according to an illustrative embodiment of the present invention. Each pusher includes a respective guide foot 17,19,21,23 for engaging the aforementioned pusher channel in the product platforms (not shown). The arrangement of the product pushers 16,18,20,22 are otherwise as illustrated in this FIG. 11.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. An expandable product pusher display assembly for displaying a plurality of products and urging the products to a front of the display assembly as individual products are removed therefrom, comprising:

left and right end caps, each having a vertical attachment face;

a first tier product pusher assembly having a first set of left and right product platforms, each attached to said vertical attachment faces of said left and right end caps, correspondingly, and each having a pusher slidably engaged therewith, and each having a means for urging said pusher toward the front of said display assembly, and wherein said first tier product pusher assembly further includes a first scissor mechanism expandably disposed between said first set of left and right product platforms and configured to adjust the distance therebetween while maintaining parallel alignment therebetween, to thereby accommodate products of different widths through adjustment of said first scissor mechanism.

2. The display assembly of claim 1, and wherein said first scissor mechanism further comprises:

left and right scissor stages attached to said first set of left and right product platforms, correspondingly, and a flat scissor link and an offset scissor link joined along their lengths by a hinge, and coupled to each of said left and right scissor stages by a pivot connection and a slide connection.

3. The display assembly of claim 2, and wherein said pivot connections are formed with a pivot pin on each of said flat and offset scissor links and a pivot hole formed in each of said left and right scissor stages, and said slide connection is formed with a slide pin on each of said flat and offset scissor links and a slide slot formed in each of said left and right scissor stages.

4. The display assembly of claim 1, and wherein said means for urging said pushers are spiral springs each having an attachment tab engaged with a corresponding one of said first set of left and right product platforms, and urgingly engaged with a corresponding one of said pushers.

5. The display assembly of claim 1, and wherein said first set of left and right product platforms are attached to said left and right end caps with plural tabs inserted into plural slots.

6. The display assembly of claim 1, and wherein each of said pushers further comprise a guide foot extending therefrom, and wherein said first set of left and right product platforms each have a guide channel formed therein for slidably engaging said guide foot.

7. The display assembly of claim 1, and further comprising:

a second tier product pusher assembly having a second set of left and right product platforms, each attached to said vertical attachment faces of said left and right end caps, correspondingly, each having a pusher slidably engaged therewith, and each having a means for urging said pusher toward the front of said display assembly, and wherein said second tier product pusher assembly further includes a second scissor mechanism expandably disposed between said second set of left and right product platforms and configured to adjust the distance therebetween while maintaining parallel alignment therebetween, and wherein said second tier product assembly is located above said first tier product pusher assembly.

8. The display assembly of claim 7, and wherein:

said first and second product pusher assemblies are adjustably attached to said left and right vertical attachment faces to facilitate adjustment of the vertical and horizontal spacing between said first and second product pusher assemblies.

9. The display assembly of claim 8, and wherein:

said first and second sets of left and right product platforms are adjustably attached to said left and right end caps with a plurality of tabs inserted into a plurality of slots.

10. A method of displaying and dispensing a plurality of products using an expandable product pusher display that includes left and right end caps, each including a vertical attachment face, and a first tier product pusher assembly that includes a first set of left and right product platforms, each attached to a vertical attachment face of the left and right end caps, correspondingly, and each including a pusher that is slidably engaged therewith, and each including a means for urging the pusher toward the front of the display assembly, wherein the first tier product pusher assembly includes a first scissor mechanism disposed between the first set of left and right product platforms, the method comprising the steps of:

adjusting the distance between the first set of left and right product platforms of the first tier product pusher assembly by adjusting the width of the first scissor mechanism to accommodate the width of the plurality of products;

inserting the plurality of products into the product pusher display, each urging the left and right pushers rearwardly against their respective means for urging the pusher forward, while maintaining parallel alignment between the first set of left and right product platforms, and urging the pushers of the first set of left and right product platforms forward by the corresponding means for urging the pusher toward the front of the display assembly upon removal of each unit of the plurality of products from the expandable product pusher display.

11. The method of claim 10, and wherein the first scissor mechanism further includes left and right scissor stages attached to the first set of left and right product platforms, correspondingly, and a flat scissor link and an offset scissor link joined along their lengths by a hinge, and coupled to each of the left and right scissor stages by a pivot connection and a slide connection, to thereby maintain the parallel alignment between the first set of left and right product platforms.

12. The method of claim 11, and wherein the pivot connections are formed with a pivot pin on each of the flat and offset scissor links and a pivot hole formed in each of the left and right scissor stages, and the slide connection is formed with a slide pin on each of the flat and offset scissor links and a slide slot formed in each of the left and right scissor stages.

13. The method of claim 10, and wherein the means for urging the pushers are spiral springs each having an attachment tab engaged with a corresponding one of the first set of left and right product platforms, and urgingly engaged with a corresponding one of the pushers.

14. The method of claim 10, and wherein each of the first set of left and right end caps are formed with plural mounting slots, and wherein each of the left and right product pusher assemblies are formed with plural mounting tabs, and further comprising the steps of:

attaching the left and right product pusher assemblies to the left and right end caps, respectively, by engaging selected mounting tabs with selected mounting slots.

15. The display assembly of claim 10, and wherein each of the pushers further include a guide foot extending therefrom, and wherein the first set of left and right product platforms each have a guide channel formed therein, and further comprising the steps of:

slidably engaging the guide feet with the guide channels.

16. The method of claim 10, wherein the product pusher display further includes a second tier product pusher assembly having a second set of left and right product platforms, each attached to the vertical attachment faces of the left and right end caps, correspondingly, each having a pusher slidably engaged therewith, and each having a means for urging the pusher toward the front of the display assembly, and wherein the second tier product pusher assembly further includes a second scissor mechanism expandably disposed between the second set of left and right product platforms, and further comprising the step of:

locating the second tier product assembly above the first tier product pusher assembly.

17. The method of claim 16, and further composing the steps of:

adjustably locating and attaching the first and second product pusher assemblies to the left and right vertical attachment faces, thereby facilitating adjustment of the vertical and horizontal spacing between the first and second product pusher assemblies.

18. The method of claim 17, and further composing the steps of:

adjustably attaching the first and second sets of left and right product platforms to the left and right end caps using a plurality of tabs inserted into a plurality of slots.

* * * * *